US009625225B2

(12) United States Patent
Sylvester

(10) Patent No.: US 9,625,225 B2
(45) **Date of Patent: *Apr. 18, 2017**

(54) ADJUSTABLE CARRIER

(71) Applicant: Primary Weapons, Boise, ID (US)

(72) Inventor: Dean Sylvester, Boise, ID (US)

(73) Assignee: Primary Weapons, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/178,165

(22) Filed: Jun. 9, 2016

(65) Prior Publication Data

US 2016/0290748 A1 Oct. 6, 2016

Related U.S. Application Data

(63) Continuation of application No. 14/456,841, filed on Aug. 11, 2014, now Pat. No. 9,372,038.

(51) Int. Cl.

| | |
|---|---|
| ***F41A 5/00*** | (2006.01) |
| ***F41A 5/28*** | (2006.01) |
| ***F41A 5/24*** | (2006.01) |
| ***F41A 3/26*** | (2006.01) |
| *F41A 13/00* | (2006.01) |

(52) U.S. Cl.

CPC *F41A 5/28* (2013.01); *F41A 3/26* (2013.01); *F41A 5/24* (2013.01); *F41A 13/00* (2013.01)

(58) Field of Classification Search

CPC ..... F41A 5/24
USPC ..... 89/193
See application file for complete search history.

(56) References Cited

U.S. PATENT DOCUMENTS

| | | | | |
|---|---|---|---|---|
| 5,551,179 | A * | 9/1996 | Young | F41A 3/12 42/16 |
| 6,681,677 | B2 * | 1/2004 | Herring | F41A 5/26 89/191.01 |
| 7,316,091 | B1 * | 1/2008 | Desomma | F41A 3/26 42/16 |
| 7,444,775 | B1 | 11/2008 | Schuetz | |
| 8,590,199 | B2 | 11/2013 | Overstreet et al. | |
| 8,596,185 | B1 | 12/2013 | Soong et al. | |
| 9,372,038 | B1 | 6/2016 | Sylvester | |
| 2010/0282066 | A1 | 11/2010 | Tankersley | |
| 2013/0098235 | A1 * | 4/2013 | Reinken | F41A 5/28 89/193 |
| 2014/0090283 | A1 * | 4/2014 | Gomez | F41A 3/26 42/25 |
| 2014/0224114 | A1 * | 8/2014 | Faxon | F41A 15/14 89/193 |

* cited by examiner

*Primary Examiner* — Samir Abdosh
(74) *Attorney, Agent, or Firm* — Schacht Law Office, Inc.; Dwayne Rogge

(57) ABSTRACT

Disclosed herein is a modified rifle bolt carrier allowing a selectively openable vent/valve at the location where exhaust gas is pressurizing the bolt carrier to control carrier speed under suppressed fire in a first valve position or unsuppressed fire in a second valve position. A valve core is disclosed which may be rotated 180° to an "open" setting for non-suppressed fire from its position in a "closed" position for suppressed fire. The modified bolt carrier will allow an operator of the firearm to adjust for a suppressor without changing the gas block or having to modify or adapt the front end of the firearm.

6 Claims, 5 Drawing Sheets

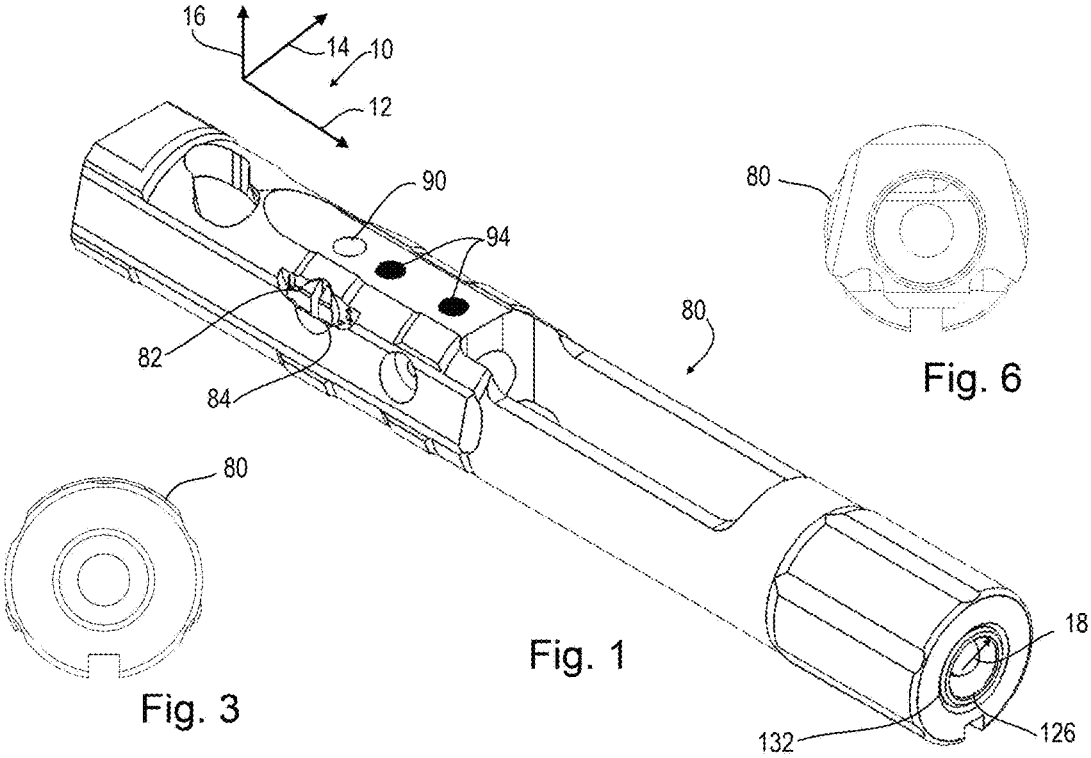
Fig. 1
Fig. 3
Fig. 6
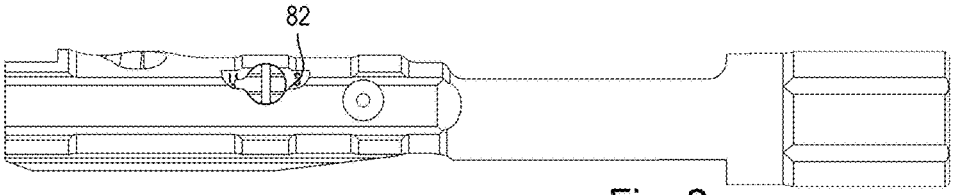
Fig. 2
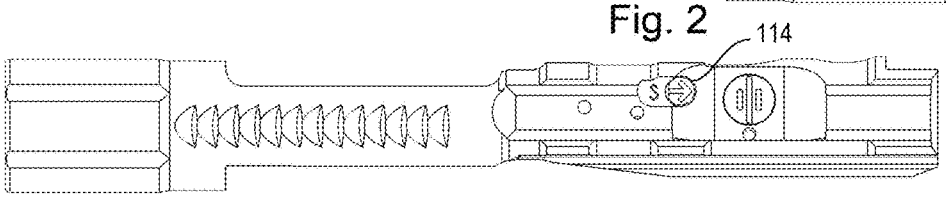
Fig. 4
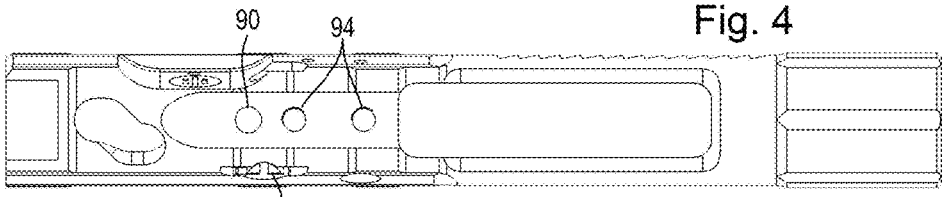
Fig. 5
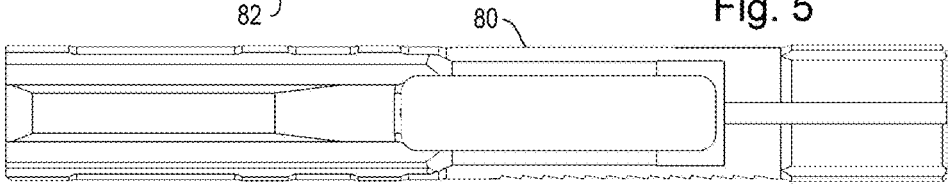
Fig. 7

ADJUSTABLE CARRIER

RELATED APPLICATIONS

This application is a continuation of U.S. Ser. No. 14/456,841 filed on Aug. 11, 2014 incorporated herein by reference.

BACKGROUND OF THE DISCLOSURE

Field of the Disclosure

This disclosure relates to the field of firearms modified for suppressed and un-suppressed fire.

BRIEF SUMMARY OF THE DISCLOSURE

Disclosed herein is a modification to a rifle bolt carrier allowing a selectively openable valve at the location where exhaust gas engages the bolt carrier to control carrier speed under suppressed fire in a first valve position or under unsuppressed fire in a second position. A valve body is disclosed which may be pushed out and rotated 180° to an "open" setting for non-suppressed fire from its original position in a "closed" position for suppressed fire. The modification will allow an operator to the firearm for a suppressor without changing the gas block or having to modify or adapt the front end of the firearm at all. The modification is mechanically simple but appears to be unknown in the art.

BRIEF DESCRIPTION OF THE SEVERAL VIEWS OF THE DRAWINGS

FIG. 1 is an isometric view of one example of the adjustable bolt carrier with gas regulator installed therein.

FIG. 2 is a right side view of the example shown in FIG. 1.

FIG. 3 is a front end view of the example shown in FIG. 1.

FIG. 4 is a left side view of the example shown in FIG. 1.

FIG. 5 is a top view of the example shown in FIG. 1.

FIG. 6 is a rear end view of the example shown in FIG. 1.

FIG. 7 is a bottom view of the example shown in FIG. 1.

DETAILED DESCRIPTION OF THE DISCLOSURE

Figure 17:
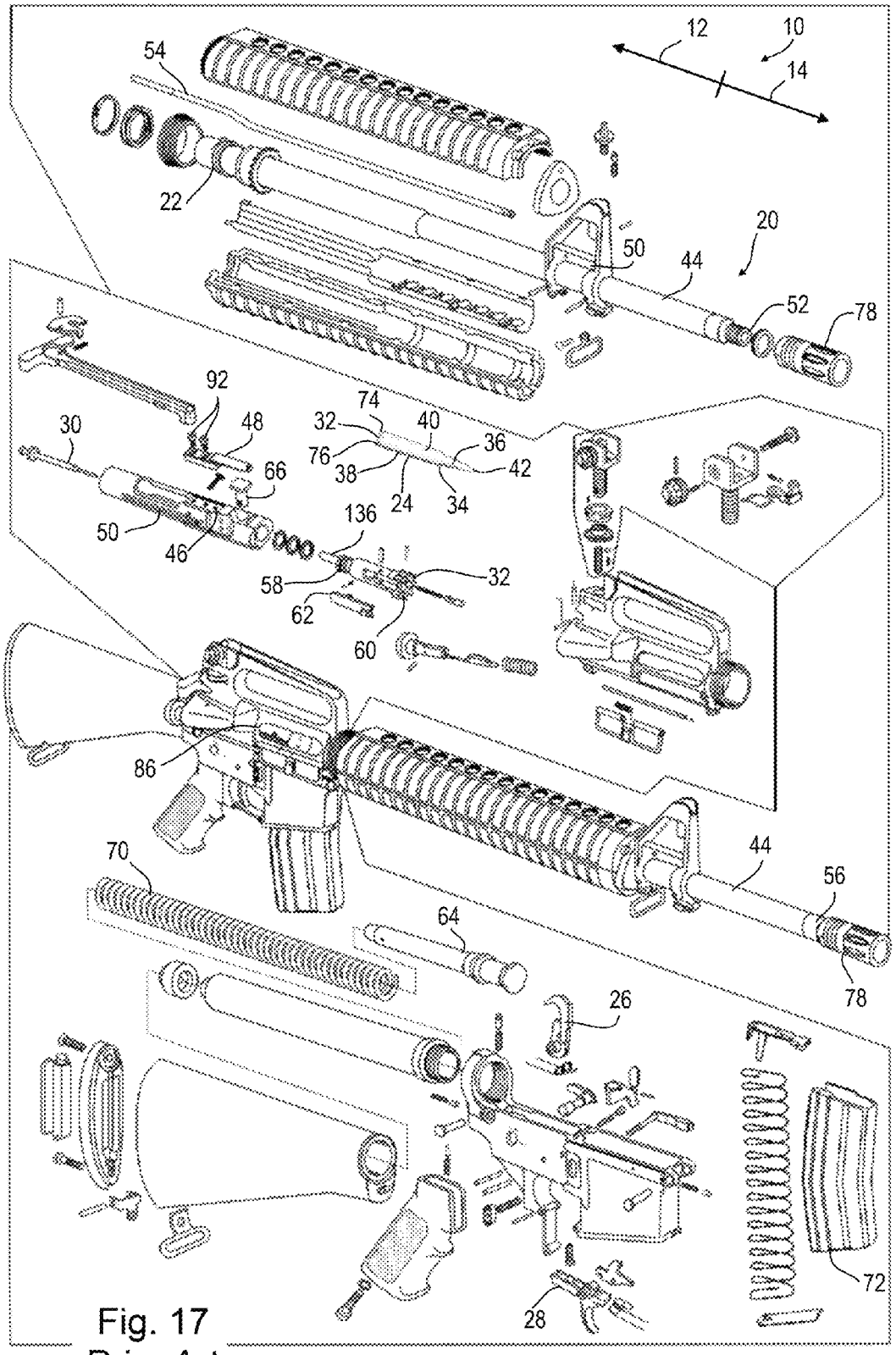
Fig. 17 Prior Art
FIG. 17 is a prior art firearm shown in an exploded and assembled view.

A description of operation of an AR 15 style firearm and apparatus is included to give background to the invention. It is to be understood that this is one example and the apparatus may be applied to SR25, AR10, and other firearm platforms. On example of this is shown in FIG. 17 representing known parts of such a firearm 20. Although an AR15 firearm is used as a specific example for description, it is to be understood that the modification disclosed herein may be applied to other firearms having similar components or operation. Beginning with a cartridge 24 in the chamber 22, the hammer 26 in the rearward position, the user actuates the trigger 28 which releases the hammer 26 towards a firing pin 30. The hammer contacts the firing pin, driving it forward towards the primer portion 32 of the cartridge 24.

In describing firearms and firearm operation, headspace is the distance measured from the part of the chamber that stops forward motion of the cartridge (the datum reference) to the face 32 of the bolt 58. Used as a verb, headspace refers to the interference created between this part of the chamber and the feature of the cartridge that achieves the correct positioning. Different cartridges have their datum lines in different positions in relation to the cartridge. For example, 5.56 NATO ammunition headspaces off the shoulder 34 of the cartridge, whereas .303 British headspaces off the rim 36 of the cartridge. If the headspace is too short, even cartridges that are in specification may not chamber correctly. If headspace is too large, the casing portion 38 of the cartridge may rupture when fired, possibly damaging the firearm and injuring the shooter Returning to a description of the firing system; as the firing pin 30 continues forward to impact and ignite the primer, the primer flash ignites a powder charge 40 within the cartridge, creating great pressure within the cartridge case. As the cartridge expands first outward towards chamber walls; pressure holds the case in place. As the case stretches rearward until the case head 76 is stopped against the bolt face.

It is common for the casing 38 which is normally made of brass to stretch rearward up to 2-4 thousandths of an inch when fired. The casing will substantially return to its original shape and size when chamber pressure subsides, allowing for reloading for center fire primers. It is generally undesirable to provide headspace for the brass to yield (permanently stretch) as the casing is generally thin just above the extraction groove. Excessive headspace is evident on a casing as a shiny ring, generally about ⅛" forward of the extraction groove.

Upon detonation of the powder charge, the bullet 42 (projectile portion of the cartridge) begins movement down the barrel 44, first encountering the throat of the barrel. It is therefore important for the throat diameter to closely match the bullet diameter. Generally, oversized throats do not control the bullet and keep it as straight while engraving into the rifling of the barrel.

As the bullet starts down the barrel, the bullet expands radially outward into the rifling where pressure causes the rifling lands to "engrave" into the bullet. Depending on the aspect ratio of the lands to grooves, the bullet will sometimes grow in length. This change in bullet shape can often be detrimental to accuracy. As the bullet has obturated and engraved into the rifling it accelerates down the bore 52 of the barrel 44.

As the bullet passes the gas port 46 of the firearm, expanded gas begins to flow into the gas block 50 where it turns and heads towards the bolt carrier 50 via the gas tube 54 and bolt carrier key 48. The gas pressure is relatively high in the barrel, often 15,00 PSI+ until the bullet leaves the muzzle end 56 of the barrel. As the bullet leaves the muzzle, gas escapes the barrel around the base of the bullet.

High pressure gas will flow along the path of least resistance, at this point out the muzzle end 56 of the barrel 44 instead of into the gas system driving the bolt carrier and associated components rearward. As the bullet exits the barrel; pressure within the barrel and chamber drops. During the bullet's travel down the barrel between the gas port and the muzzle end of the barrel, a metered amount of gas is provided from the gas block 50 through the gas tube 54 to the bolt carrier key 48.

The gas pressure upon reaching the bolt carrier key 48 attached to or formed with the top of the bolt carrier is conducted into the bolt carrier where it expands. Gas expanding in this region of the bolt carrier forces the bolt carrier rearward 12 and forces the bolt forward 14. The bolt 58 is also forced rearward by the gas pressure expanding the cartridge case on the other side of the bolt. For a short moment in time, these forward and rearward forces are substantially equal. During this, the bolt lugs 60 unlock before the extractor 62 forces the casing rearward and laterally outward through ejector port 86. At this point the bolt carrier 50 begins to move rearwards 12 against the inertia of the bolt carrier's weight, the buffer's 64 weight, and the operating spring 70. All of these relative movements affect timing of the mechanical operation. Buffers 64 are provided in several "weights" to account for these factors: standard, heavy (H), H2, H3 etc.

As the bolt carrier travels rearward, a cam pin 66 provided through the bolt encounters cam surfaces. Rearward movement of the bolt carrier 50 as the cam pin 66 contacts the cam surfaces causes the bolt to rotate.

As the firearm is fired, gas pressure in the case holds the case into the chamber, even though the chamber may be slightly tapered.

As the gas pressure is released out the muzzle end 56 of the barrel 44, the cartridge casing will substantially return to its previous size. Thus the casing is no longer a tight fit in the chamber as during firing when the gas pressure within the casing is high.

It is important to operation that the bullet exits the muzzle end of the barrel and the gas pressure within the casing reduces enough that the casing returns substantially to its pre-fired size before the bolt lugs are unlocked. Often, when the pressure is high, the case can be jammed in the chamber. One indicator of such high pressures is that the casing extrudes into the ejector plunger hole on the bolt and the resulting pressure unlocks the bolt while gas pressures are still high.

Returning to a description of extraction of the spent cartridge or casing, as pressure subsides, the bolt is unlocked, bolt carrier momentum continues rearward, pulling the spent cartridge casing from the chamber.

As the cartridge case reaches the ejection port, the spent casing pivots on the extractor hook from pressure of the ejector until the spent casing is ejected from the firearm through the ejector port 68.

The bolt carrier continues rearward after ejection of the spent cartridge while re-setting the hammer 26 of the firearm to a position ready for firing until operating spring pressure or the buffer stops rearward motion of the bolt carrier.

Once rearward motion of the bolt carrier ceases, the operating spring 70 (buffer spring) returns the bolt carrier forward. As the bolt carrier travels forward it strips a new unfired cartridge from the magazine 72 up the feed ramp and into the chamber. The cartridge stops as the cartridge is seated in the chamber, the bolt continues forward, causing the extractor to snap over the rim 74 of the cartridge casing. The bolt 58 will stop against the case head 76, and the bolt carrier 50 continues forward. The cam surfaces in the carrier now cause the bolt to lock into firing position. The firearm is then set as described at the beginning of this process.

Many shooters prefer to use sound or flash suppressors 78 on firearms obviously to reduce muzzle audio volume or muzzle flash. One problem with such suppressors is the effect such suppressors have on firearm function, particularly to bolt carrier movement during firing. Gas pressure increases are a common result of suppressor attachment to firearms. A semi-automatic firearm for example requires a specific volume and pressure of gas directed to the bolt carrier to function properly as described above. When fired without a suppressor, the majority of excess gas pressure expands out of the muzzle end of the barrel into the atmosphere after the projectile exits the bore. When that same gas pressure is affected by a suppressor's baffles instead of exiting freely from the muzzle 56, a significant is reflected back into the gas system/barrel. Some of this increased gas pressure is directed to the gas block 50 through the gas tube 54 to the bolt carrier 50. The resulting greater force applied by this increased gas pressure to the bolt carrier is often more than needed to operate the action of the bolt carrier and bolt, and therefore can result in malfunction of the firearm. A modification is thus disclosed herein of a valve to offset such variance in gas pressure.

Direct-gas-impingement systems as disclosed above are typically non-adjustable as built. While user-adjustable regulators are available as commercial retrofits, they fail to fit the needs of shooters wishing to change from suppressed to non-suppressed fire in the field. These adjustable regulators often rely on setscrews for adjustment and lack positively indexed settings. Other known options to adjust changes to bolt and carrier speeds including heavier bolt carriers, different buffer springs and changing buffer weights. Internal suppressor-design differences yield vastly different performance results depending in part on the firearm to which they are attached and the cartridge used.

As described, suppressors normally increase pressure inside a firearm's gas system, in particular gas pressure provided to movement of the bolt carrier. Two known common ways to account for this change in gas pressure to the bolt carrier is to increase buffer weight or use a hydraulic buffer.

Disclosed herein as shown in the example of FIG. 1 is a modified rifle bolt carrier 80 providing a selectively openable valve 82 at the location where exhaust gas is directed from the bolt carrier key 48 to the bolt carrier 80 to control carrier speed under suppressed fire in a first valve position (U) or unsuppressed fire (S) in a second valve position.

To adjust operation of the gas operated bolt carrier from suppressed fire to unsuppressed fire, a valve 82 comprising a valve core 84 fitted within a valve housing 88 (FIG. 15) is disclosed. In one example which may rotate 180° to an "open" (U) position for non-suppressed fire from its position in a "closed" (S) position for suppressed fire. The modified bolt carrier 80 with the valve 82 will allow an operator of the firearm to adjust for a suppressor without changing the gas block or changing the front end of the firearm at all.

Figure 14:
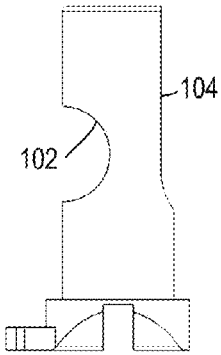
FIG. 14 is an opposing side view of the example shown in FIG. 13.
Figure 9A:
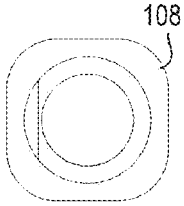
FIG. 9*a* is an end view of the example shown in FIG. 8*a*.
Figure 15:
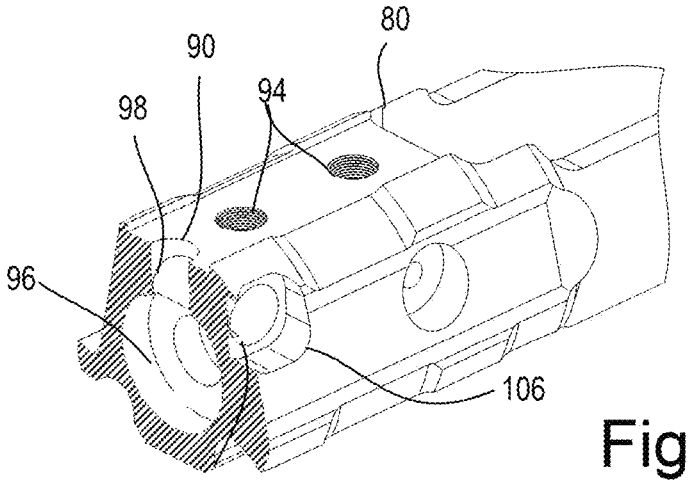
FIG. 15 is a cutaway isometric view of the adjustable carrier component of FIG. 8*a* with the gas regulator removed for illustration.
Figure 16:
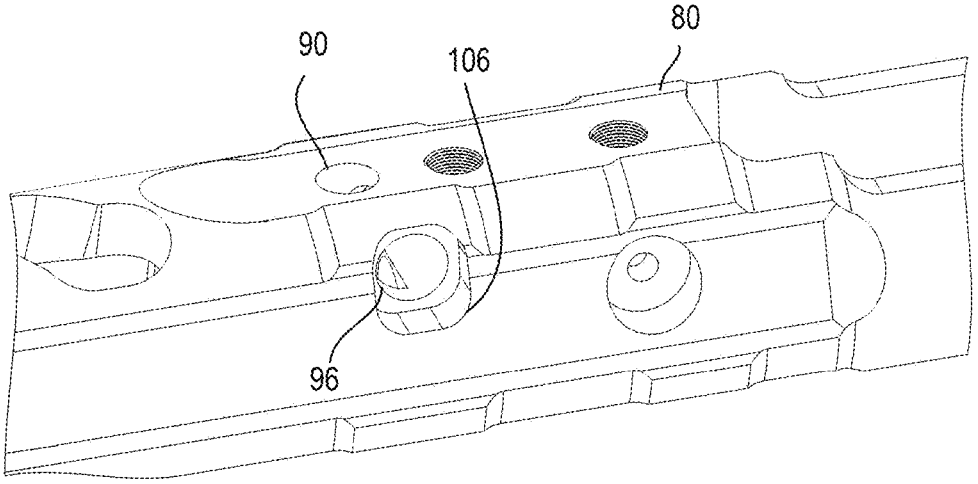
FIG. 16 is a cutaway isometric view of the adjustable carrier component of FIG. 8*a* with the gas regulator removed for illustration.
Figure 19:
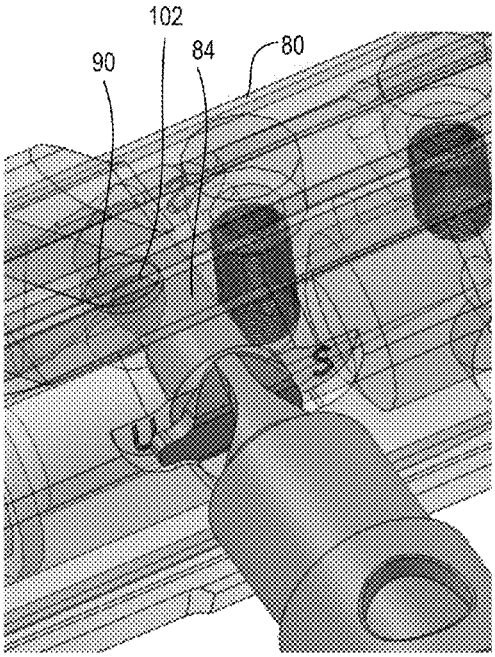
FIG. 19 is a view of the example shown in FIG. 19 from another view.
Figure 20:
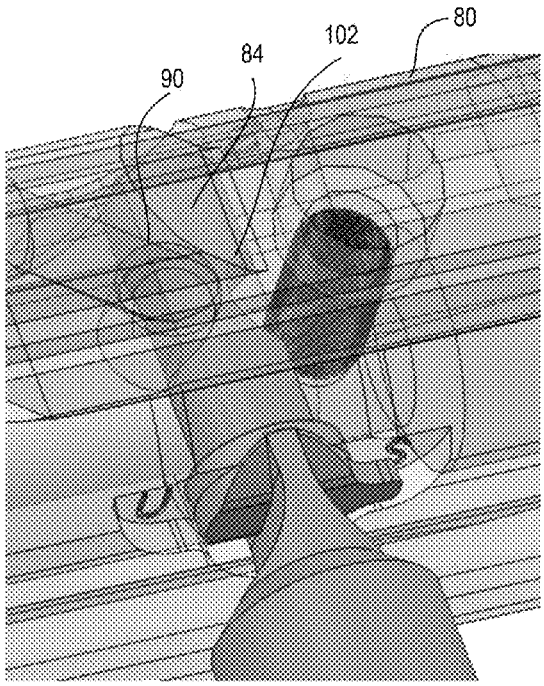
FIG. 20 is a view of the example shown in FIG. 19 from another view and with the gas regulator or valve in a different rotational position.

FIG. 15 shows a cutaway view of the modified bolt carrier 80 taken orthogonal to a gas port 90. The gas port 90 when assembled with all other components provides a conduit to the gas tube 54 via the bolt carrier key 48. The bolt carrier key 48 may be attached to the bolt carrier 80 by way of fasteners 92 which engage female threaded voids 94 in the modified bolt carrier 80. As shown, the gas port 90 provides a conduit from the bolt carrier key 48 to an inner chamber 96 as previously described. The valve 82 as mentioned comprises the valve core 84 as shown in FIGS. 8-14 fitted into the valve housing 88 which in this example comprises a substantially cylindrical female surface 98 into which a substantially cylindrical outer surface 100 of the valve core 84 fits in a close sliding fit. A close sliding fit is defined herein an engineering fit between two parts without a noticeable gap there between. In this way, there is no noticeable gap between the cylindrical outer surface 100 of the valve core 84 and the substantially cylindrical female surface 98 of the valve housing 88 two allow gas pressure to transfer there between. As can be appreciated by looking to FIG. 19, when the valve port surface 102 of the valve core 84 is aligned vertically to the gas port 90, the valve core 84 provides little or no obstruction to the gas port 90. In this unsuppressed (U) position, use of the firearm without a suppressor is facilitated. Comparing this to the example of FIG. 20, it can be seen that the valve port surface 102 is not aligned with the valve port 90. In this position, the valve core 84 occludes a significant portion of the gas port 90. In this suppressed (S) position, use of the firearm with a suppressor is facilitated in that the valve core 84 reduces the gas volume and pressure transferring between the 48 and the bolt carrier 50.

Figure 8:
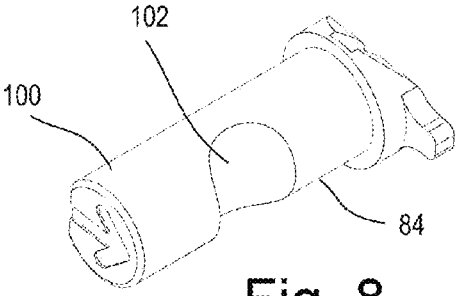
FIG. 8 is an isometric view of one example of the gas regulator component of FIG. 1.
Figure 9:
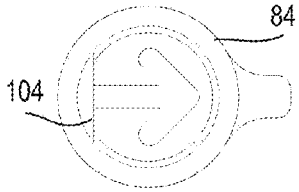
FIG. 9 is an end view of the example shown in FIG. 8.
Figure 13:
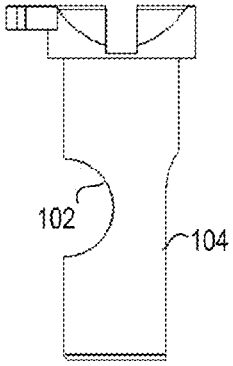
FIG. 13 is a side view of the example shown in FIG. 8.
Figure 10:
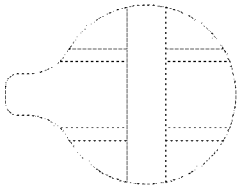
FIG. 10 is an opposing end view of the example shown in FIG. 9.
Figure 11:
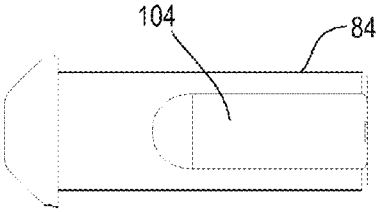
FIG. 11 is a top view of the example shown in FIG. 8.
Figure 12:
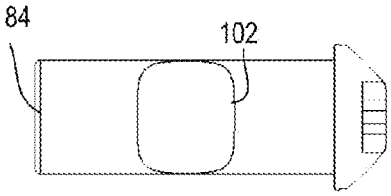
FIG. 12 is a bottom view of the example shown in FIG. 8.

Looking to FIGS. 11 and 13-14 it can be seen that in this example, the valve core 84 has a valve depressed surface 104. While shown as a substantially planar surface, the surface may be specifically configured by machining to conform to a specific combination of firearm/ammunition/suppressor to provide the proper gas flow there past through the gas port 90.

Figure 8A:
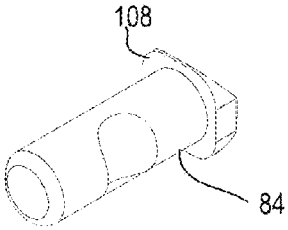
FIG. 8*a* is an isometric view of one example of the gas regulator component.
Figure 10A:
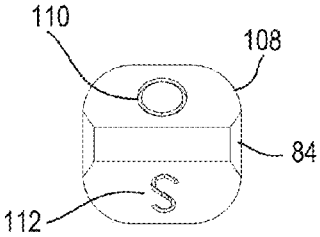
FIG. 10*a* is an opposing end view of the example shown in FIG. 9*a*.

In the example shown in FIGS. 8*a* and 15*a*, an example is shown wherein a stop surface 106 is provided on the bolt carrier 80 which is non-circular in cross-section. A corresponding stop surface 108 is formed in the outer portion of the valve core 84 so as to engage the surface 106 of valve core 84 relative to the bolt carrier 80. In this example, the valve core 84 may be repositioned (pushed transversely outward such that the surface 108 does not engage the surface 106 prior to rotation. In addition, indicators 110 and 112 are provided for indication of the position of the valve core 84 in an unsuppressed fire position and suppressed fire position respectively. To disengage the surface 108 from the surface 106 in this example, a shooter may use a tool to press against the rearward side 114 (FIG. 4) transversely and then the valve core 84 may be rotated.

Figure 18:
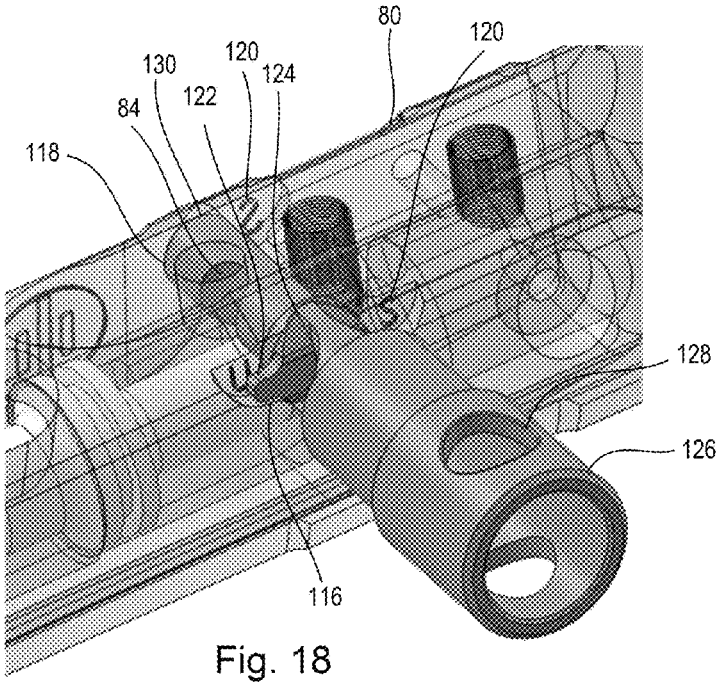
FIG. 18 is a transparent line view of an example of the adjustable bolt carrier with gas regulator installed therein.

Looking to the example shown in FIGS. 18-20, again the bolt carrier 80 has a stop surface 116 which may be non-circular in cross-section so as to limit rotation of the valve core 84 beyond a specified range such as between the suppressed and unsuppressed positions. Markings 118 and 120 may be provided on the bolt carrier 80 or on the valve core 84. As shown in FIG. 18, these markings may be on either or both lateral sides of the valve core 84 and/or bolt carrier 80. Although the stop surface 116 limits rotation of the valve core 84 as the protrusion (stop surface) 122 contacts it, rotation between the unsuppressed position 118 and suppressed position 120 may only be limited by a tight friction fit between the cylindrical outer surface 100 of the valve core 84 and the cylindrical surface 98 of the bolt carrier 80. In such an example, the outer portion of the valve core 84 may comprise a surface 124 for engagement of a tool 126 which in the example shown is substantially a flathead screwdriver. The tool allows the shooter to overcome rotational friction between the valve core 84 and the valve housing 88.

In one form, where lateral movement of the valve core 84 is not required to rotate the valve core 84 relative to the bolt carrier 80, the tool 126 may comprise a surface 128 which does not have circular symmetry. This surface may be used to engage the tail end 130 of the valve core 130 if additional leverage is required.

Figure 21:
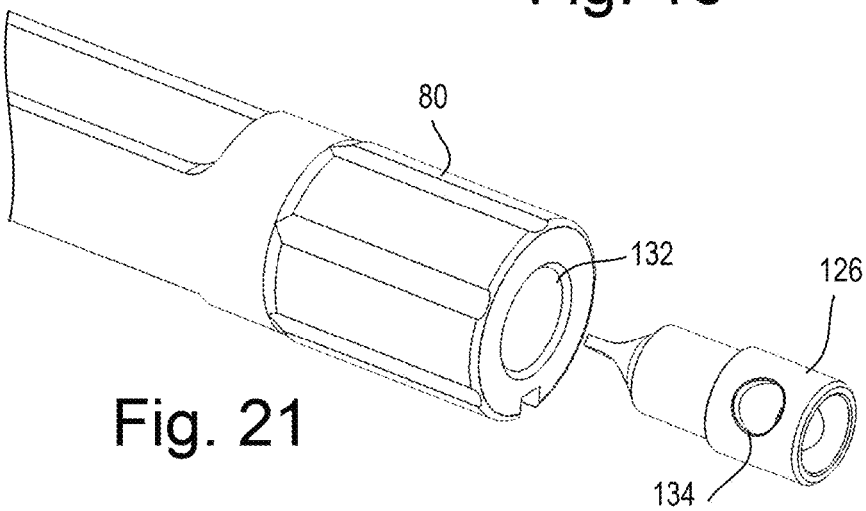
FIG. 21 is a partial view of FIG. 1 with the tool removed therefrom.

In one example, the bolt carrier 80 has a surface 132 in the end thereof for storage of the tool 126 as shown in FIGS. 1 and 21.

In addition, a surface defining a hole 134 in the tool 126 is provided orthogonal to the axis of the tool. This hole 134 is used to accept a tail end 136 of the bolt 58 (See FIG. 17) or other rigid items to utilize additional rotational force upon the tool 126 and valve core 84.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A gas operated firing assembly for a firearm, the assembly comprising;

a bolt carrier having a longitudinal axis;

a surface defining a vertical gas port orthogonal to the bolt carrier longitudinal axis;

a surface of the bolt carrier defining a lateral valve housing orthogonal and intersecting the vertical gas port and orthogonal to the bolt carrier longitudinal axis;

a valve core having an outer surface in close sliding fit to the valve housing so as to rotate therein without appreciable gas transfer there between the outer surface and the valve housing; and the valve core having a surface at least partially and selectively controls flow thorough the vertical gas port.

2. A gas operated firing assembly for a firearm, the assembly comprising:

a bolt carrier having a longitudinal axis;

a surface defining a vertical gas port orthogonal to the bolt carrier longitudinal axis;

the vertical gas port in fluid communication with a gas block forward of a chamber of the firearm via a gas tube when the firearm is assembled;

a surface of the bolt carrier defining a lateral valve housing orthogonal and intersecting the vertical gas port and orthogonal to the bolt carrier longitudinal axis;

a valve core having an outer surface in close sliding fit to the valve housing so as to rotate therein without appreciable gas transfer there between the outer surface and the valve housing;

the valve core having a surface which at least partially and selectively controls flow thorough the vertical gas port;

wherein the outer surface of the valve core is in close sliding fit to the valve housing so as to laterally reposition and rotate therein;

a stop surface of the valve core laterally outward of the outer surface of the valve core;

a stop surface of the bolt carrier laterally outward of the valve core;

wherein the stop surface of the bolt carrier contacts the stop surface of the valve body and prohibits rotation thereof when the valve core is positioned laterally inward from a position at which the valve core is rotatable.

3. The assembly as recited in claim 2 wherein the outer surface of the valve core is in close sliding fit to the valve housing so as to laterally reposition and rotate therein.

4. The assembly as recited in claim 2 further comprising:

a tool engagement surface on the valve core;

the tool engagement surface is not circularly symmetric;

a tool having a surface to couple to the tool engagement surface so as to selectively provide rotational force to the valve core when the tool is rotated.

5. A gas operated firing assembly for a firearm, the assembly comprising:

a bolt carrier having a longitudinal axis;

a surface defining a vertical gas port orthogonal to the bolt carrier longitudinal axis;

the vertical gas port in fluid communication with a gas block forward of a chamber of the firearm via a gas tube when the firearm is assembled;

a surface of the bolt carrier defining a lateral valve housing orthogonal and intersecting the vertical gas port and orthogonal to the bolt carrier longitudinal axis;

a valve core having an outer surface in close sliding fit to the valve housing so as to rotate therein without appreciable gas transfer there between the outer surface and the valve housing;

the valve core having a surface which at least partially and selectively controls flow thorough the vertical gas port;

the valve core comprises a valve port surface which is detented from the outer surface of the valve core; and wherein the valve port surface is selectively aligned with the vertical gas port of the bolt carrier in an unsuppressed position such that the valve core does not substantially occlude the vertical gas port.

6. The gas operated firing assembly as recited in claim 5 further comprising a valve depressed surface on the valve body radially opposed to the valve port surface relative to the outer surface of the valve core.

* * * * *